US005312284A

United States Patent [19]

Grober et al.

[11] Patent Number: 5,312,284

[45] Date of Patent: May 17, 1994

[54] INCREMENTALLY MOVED CYLINDRICAL LENS DISPLAY SYSTEM FOR TOY

[75] Inventors: David E. Grober, Huntington Beach; Raymond J. Gross, Culver City, both of Calif.

[73] Assignee: Mattel, Inc., El Segundo, Calif.

[21] Appl. No.: 14,290

[22] Filed: Feb. 5, 1993

[51] Int. Cl.[5] ..... A63H 33/30

[52] U.S. Cl. ..... 446/143; 446/148; 446/152; 40/347; 40/527

[58] Field of Search ..... 446/143, 148, 149, 151, 446/152, 408; 40/347, 524, 527; 424/118, 227

[56] References Cited

U.S. PATENT DOCUMENTS

| | | | |
|---|---|---|---|
| 3,114,216 | 12/1963 | Crawford et al. . | |
| 3,388,499 | 6/1968 | Mercorelli . | |
| 3,590,525 | 7/1971 | Tomaro . | |
| 4,182,071 | 1/1980 | Todokoro . | |
| 4,215,511 | 8/1980 | Todokoro . | |
| 4,295,036 | 10/1981 | Tsui | 446/143 X |
| 5,032,099 | 7/1991 | Chan . | |

FOREIGN PATENT DOCUMENTS

| | | | |
|---|---|---|---|
| 150460 | 8/1985 | European Pat. Off. | 446/143 |
| 460946 | 12/1991 | European Pat. Off. | 446/143 |
| 268519 | 3/1972 | United Kingdom | 446/143 |
| 2236490 | 4/1991 | United Kingdom . | |

*Primary Examiner*—Danton D. DeMille
*Attorney, Agent, or Firm*—Roy A. Ekstrand

[57] ABSTRACT

A toy computer includes a keyboard housing and a monitor housing pivotally secured by a hinge coupler. A depressible keyboard unit is pivotally supported by the keyboard housing and is coupled to a movable slider within the interior of the keyboard housing. A return spring is coupled to the slider and is operative to pivot the slider such that a ratchet engaging tooth is raised to its engagement position in the absence of a keyboard unit stroke. An endless belt display utilizes a cylindrical lens element array together with a segmented image formed on the endless belt to provide apparent motion of the image as the endless belt is moved. A ratchet coupling system is coupled between the slider and the movable belt to provide incremental belt motions in response to each keyboard stroke.

11 Claims, 2 Drawing Sheets

INCREMENTALLY MOVED CYLINDRICAL LENS DISPLAY SYSTEM FOR TOY

FIELD OF THE INVENTION

This invention relates generally to toy display systems and particularly to a simulated computer monitor display for toy computer.

BACKGROUND OF THE INVENTION

Toys utilizing sound or other action together with visual displays have, through the years, developed into an extremely popular type of toy with children of broad age ranges. Many such toys have been developed which provide music, rotating carousels, illuminated projections and the like often resembling music boxes. Still others have been provided which imitate radios or television sets in their general appearance with corresponding functional characteristics which simulate their operation. Within such devices, the display systems used very substantially. Some devices utilize a scrolling belt-like roll bearing a series of images together with a moving mechanism which scrolls the images past an aperture or other viewing area. Some devices utilize a plurality of movable cards often centrally disposed about a rotating shaft to be flipped into a visible alignment in accordance with shaft rotation. Still others utilize illuminated drums or other movable, rotatable image bearing structures together with a light source to provide a series of viewable pictures.

One of the more interesting types of toy display systems used is that provided by a segmented lenticular system in which an image roll having a parallel series of image lines formed in multiple segments thereon is continuously scrolled past a lens system. The lens system typically utilizes a plurality of parallel cylindrical lens overlying at least a portion of the moving picture roll. The alternate magnifying and obscuring of the underlying segments of the picture roll as the picture moves beneath the lens system together with the arrangement and character of the picture image segments provides the illusion of image motion.

Thus, a great variety of display systems in toy devices have been provided by the art. For example, U.S. Pat. No. 4,182,071 issued to Todokoro sets forth a TOY TELEVISION SET which is also set forth in U.S. Pat. No. 4,215,511 also issued to Todokoro and entitled TOY TELEVISION SET WITH MUSICAL BOX. The toy television sets set forth therein employs a housing defining a viewing screen aperture behind which a rotatable shaft is generally centered and extends horizontally. A plurality of image cards are loosely secured to the centered shaft and are displayed in pairs to generally fill the image screen as the shaft is rotated. An indexing member controls the card position to provide sequential exposure of each card as the cards are flipped into visible position by rotation of the shaft.

U.S. Pat. No. 3,590,525 issued to Tomaro sets forth a TOY MOVING PICTURE AND AUDIO SYNCHRONIZING MECHANISM in which a story telling toy includes a housing having an interior cavity supporting a rotating image bearing drum behind a viewing aperture simulating a television viewing screen. An audio play device is operative within the housing to replay the audio track of a prerecorded story. The drum is rotated in synchronism with the audio information on the recorded story track to provide simultaneous image and audio information.

U.S. Pat. No. 5,032,099 issued to Chan sets forth a TOY MUSICAL BOX which is also the subject of a counterpart British Application No. 2236490. The toy musical box includes electronic musical sound reproduction systems together with an electric drive motor for moving an endless band carrying a continuous past a window. The music box may resemble a television set in general appearance. The operation of the sound reproduction circuit and the motor are remotely controlled by sound impulses from a separate hand-held device. A lenticular system comprising a plurality of cylindrical lenses in parallel array is formed upon the simulated television viewing screen and the continuous picture is segmented to provide the appearance of motion as it is continuously moved past the cylindrical lens system.

U.S. Pat. No. 3,114,216 issued to Crawford et al sets forth a SOUND AND PICTURE TOY having a rectangular housing within which a rotatable disk is supported and coupled to a forwardly extending knob. An aperture is positioned in the frontal portion of the housing to frame a single segment of the disk which bears a plurality of images radially spaced about the outer portion of the disk. A musical drive system rotates the disk moving the images past the viewing window and playing music.

U.S. Pat. No. 3,388,499 issued to Mercorelli sets forth a SIMULATED TELEVISION SET INCLUDING DIORAMA AND MUSIC BOX in which a housing replicating a television receiver and defining a viewing screen aperture supports a pair of parallel rollers between which an image bearing belt is scrolled past the viewing aperture.

While the foregoing described prior art systems have provided some measure of enjoyment and entertainment and have improved visual display toys generally, there remains nonetheless a continuing need in the art for ever improved toy display systems.

SUMMARY OF THE INVENTION

Accordingly, it is a general object of the present invention to provide an improved display system for a toy. It is a more particular object of the present invention to provide an improved display system for a toy which is suitable for mimicking the display system of a computer in the toy environment.

In accordance with the present invention, there is provided a toy display system which comprises a housing defining a viewing aperture and keyboard surface, a depressible key supported upon the keyboard surface, a movable image display producing an image viewable through the viewing aperture, and incremental coupling means coupling the depressible key to the movable image display to incrementally move the image in response to each depression of the key.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
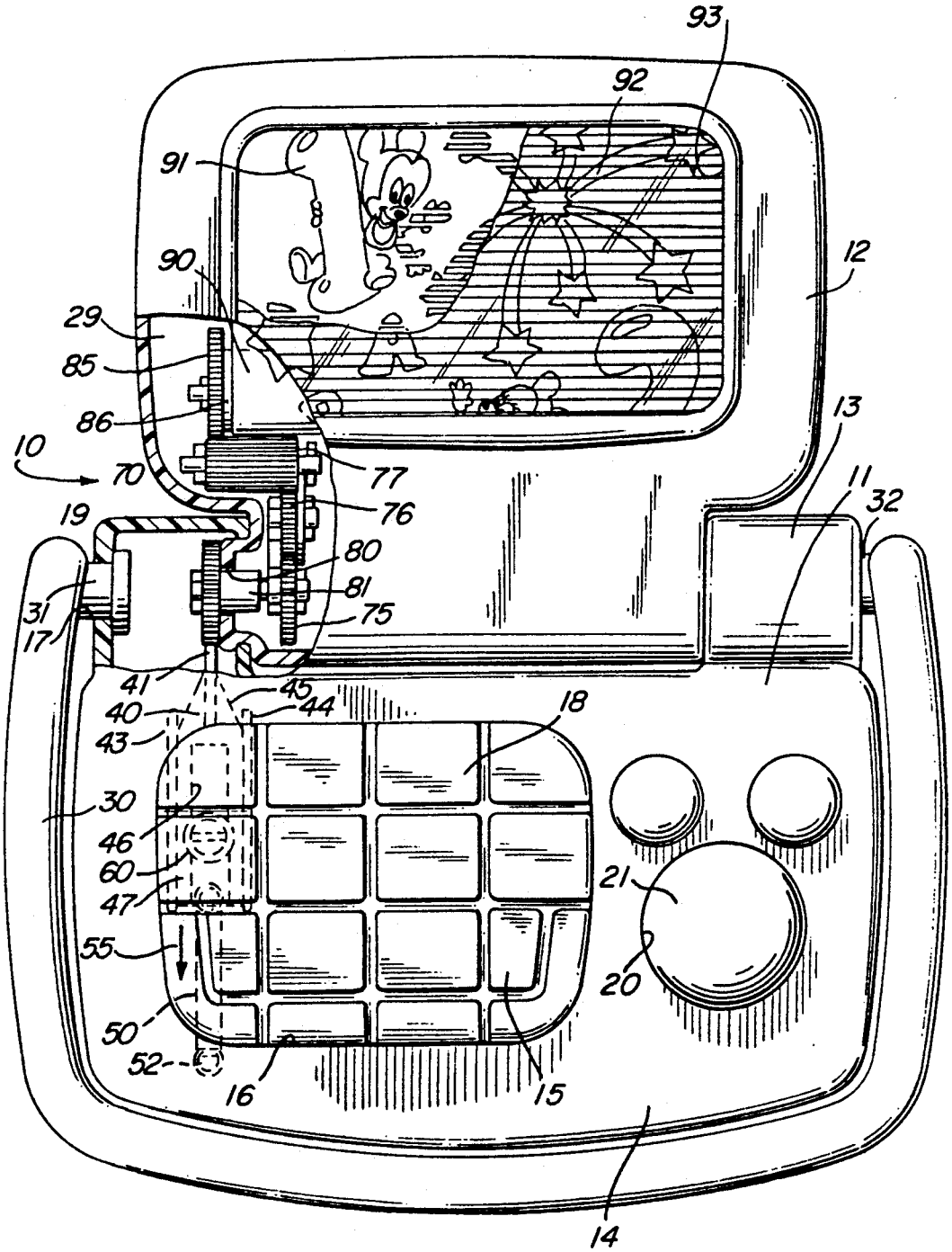
FIG. 1 sets forth a partially sectioned front view of a toy computer utilizing the present invention incrementally moved cylindrical lens display system.

FIG. 1 sets forth a partially sectioned front view of a toy computer generally referenced by numeral 10. Toy computer 10 is intended to replicate a lap-top type personal computer in a fanciful children's version. Toy computer 10 includes a generally planar keyboard housing 11 and a generally planar monitor housing 12. Housings 11 and 12 are pivotally coupled by a hinge coupling 13. Keyboard housing 11 further defines a planar keyboard surface 14 defining an aperture 20 supporting a rotatable simulated track ball 21 extending partially upwardly through aperture 20. Keyboard surface 14 further defines a generally rectangular aperture 16 within which a keyboard unit 15 is pivotally supported in the manner set below in FIG. 2. Suffice it to note here that keyboard unit 15 is preferably segmented to form a plurality of simulated keys 18. A generally U-shaped handle 30 includes a pair of inwardly extending cylindrical posts 31 and 32 which are pivotally coupled to keyboard housing 11. For example, housing 11 defines an aperture 17 which receives post 31 to provide this pivotal attachment. It should be understood that post 32 is similarly received within an aperture (not shown) formed in housing 11. Thus, handle 30 may be pivoted upwardly to provide a convenient carrying handle.

A pair of generally straight line, elongated guide members 43 and 44 are formed within interior cavity 19 within keyboard housing 11 to form an elongated channel 45 therebetween. An elongated slider member 40, better seen in FIG. 2 below, is slidably received within channel 45 and is movable in the directions indicated by arrows 54 within channel 45. Slider 40 further includes a forwardly extending tyne 41 which, as is set forth below in greater detail, engages a ratchet 70. Slider 40 further defines an upper surface 47 defining an elongated slot 46 which receives a cylindrical post 60 formed within interior cavity 19 of keyboard housing 11. As a result, slot 46 and post 60 cooperate to maintain slider 40 within channel 45 in a sliding captivation. A coil spring 51 is secured to the rear portion of slider 40 and is coupled to a tab 52 formed within interior cavity 19 of keyboard housing 11. Spring 51 is stretched or elongated to provide a spring force urging slider 40 rearwardly in the direction indicated by arrow 55. As is better seen in FIG. 2, keyboard housing 11 further defines an extending limit stop 50 which limits the travel of slider 40 in the direction of arrow 45.

By means set forth below in greater detail, keyboard unit 15 is pivotally secured to keyboard housing 11 and includes a downwardly extending finger 26 which engages slider 40 such that the child user's pressing of keyboard unit 15 pivots keyboard unit 15 moving slider 40 forwardly and driving tyne 41 against ratchet 70 to provide an incremental rotational movement thereof. Spring 51 resists the downward pivotal motion of keyboard unit 15 and thus once the child user removes the downward pressure from keyboard unit 15, spring 51 returns slider 40 to the position shown in FIG. 1 and raises keyboard unit 15 to the raised position also shown.

Monitor housing 12 defines a generally rectangular aperture 93 and an interior cavity 29. A pair of rollers 86 and 87 (the latter seen in FIG. 2) are rotatably supported in a parallel arrangement within interior cavity 29 in accordance with conventional fabrication techniques. An endless belt 90 is received upon and stretched between rollers 86 and 87 to provide a rotational coupling force therebetween. Endless belt 90 further supports a plurality of image segments 91 depicting various motions of the images formed by the combination of image segments 91. A cylindrical lens array 92 is supported upon monitor housing 12 and extends across aperture 93. As is better seen in FIG. 2, cylindrical lens array 92 forms a plurality of parallelly arranged magnifying cylindrical lens elements 95 and alternate interleaved valley portions 96. Cylindrical lens array 92 and image segments 91 cooperate to obscure and magnify alternate portions of image segments 91 as endless belt 90 is moved to provide the appearance of motion of the images supported upon endless belt 90.

Monitor housing 12 defines an aperture 80 which receives a rotatable post 81 having ratchet gear 70 and a drive gear 75 coupled to either side thereof. Post 81 and aperture 80 cooperate to form one-half of hinge coupling 13 between monitor housing 12 and keyboard housing 11. While not seen in FIG. 1, it should be understood that hinge coupling 13 includes an additional similar pivotal coupling on the opposite side of monitor housing 12 to complete the hinge coupling. Gear 75 is rotatable in correspondence with pivotal motion of ratchet 70 and is coupled to the gear 76 which in turn is coupled to a gear 77. Roller 86 includes a gear 85 which engages gear 77. Thus, rotational motion of ratchet produces corresponding rotational motion of gear 75 which is coupled by gear 76 and 77 to gear 85 producing a rotational motion of roller 86. The frictional coupling between roller 86 and roller 87 provided by belt 90 produces a corresponding rotation of roller 87 and movement of endless belt 90.

In operation, and as is set forth below in greater detail, the child user presses keyboard unit 15 producing a forward motion of slider 40 which in turn moves ratchet 70 in a rotational increment. A corresponding incremental rotation is produced in gear 75 and coupled to endless belt 90 by the above-described gear coupling. When the child user releases keyboard unit 15, slider 40 is returned to its initial position and keyboard unit 15 is raised through the action of spring 51. As the child user applies successive keystrokes to keyboard unit 15, successive incremental motions forward and back of slider 40 produce corresponding incremental motions of ratchet 70 which in turn produce incremental motions of endless belt 90. Correspondingly, the incremental motions of endless belt 90 move image segments 91 incrementally with respect to cylindrical lens array 92 providing a detented or incremental motion. In accordance with the invention, image segments 91 are sized and configured in accordance with the incremental motion of endless belt 90 produced by each stroke upon keyboard unit 15. Thus the action of keyboard stroke and incremental change of displayed image within monitor housing 12 provides a fanciful but realistic computer-like action for the child user and represents an early introduction to the action of a computer.

Figure 2:
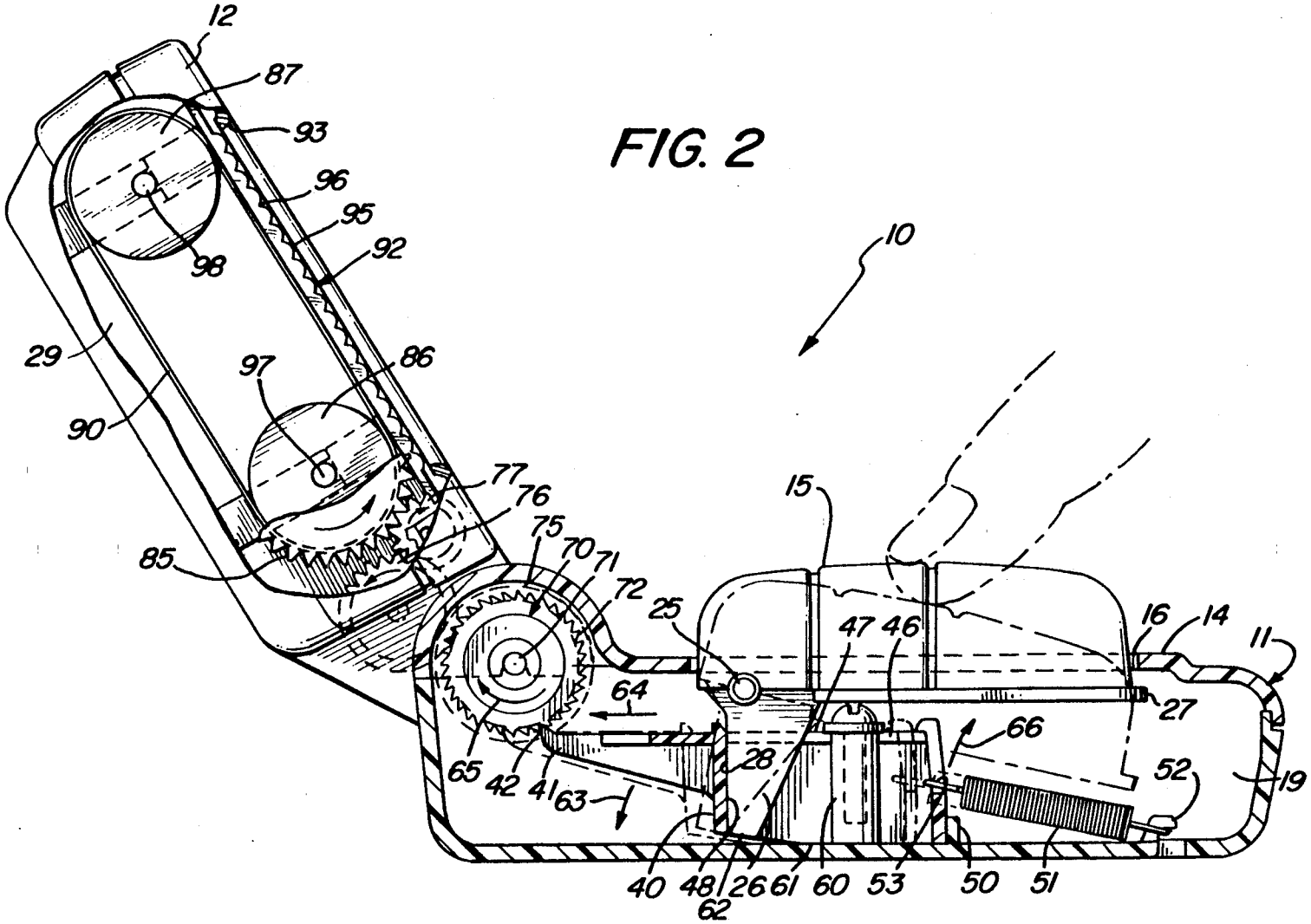
FIG. 2 sets forth a partially sectioned side view of the toy of FIG. 1.

FIG. 2 sets forth a partially sectioned side view of toy computer 10. As described above, toy computer 10 includes a keyboard housing 11 defining an interior cavity 19 and a generally planar keyboard surface 14.

Keyboard surface 14 defines an aperture 16 within which a generally rectangular keyboard unit 15 is pivotally supported by a pivot pin 25 in accordance with conventional fabrication techniques. Keyboard housing 11 further defines a cylindrical post 60 extending upwardly within cavity 19 and an upwardly extending limit stop 50 and spring tab 52. An elongated slider 40 is slidably movable within channel 45 between guides 43 and 44 (seen in FIG. 1) and is maintained in position by the cooperation of post 60 and a slot 46 formed in upper surface 47 of slider 40. Slider 40 further defines a bottom surface 61 and an upwardly angled surface 62. Keyboard unit 15 further includes a downwardly extending finger 26 which extends through slot 46 of slider 40 and defines a forward edge 28 which is received against front surface 48 of slider 40. Slider 40 further includes a forwardly extending tyne 41 which in turn defines an upwardly extending tooth 42.

Monitor housing 12 is pivotally secured to keyboard housing 11 and defines an interior cavity 29 defining a rectangular viewing aperture 93. A cylindrical lens array 92 comprising parallel rows of cylindrical magnifying elements 95 and alternately interleaved valley portions 96 is supported beneath aperture 93. A pair of cylindrical rollers 86 and 87 are rotatably supported within interior cavity 29 by a pair of rotatable shafts 97 and 98, respectively. An endless belt 90 is received upon rollers 86 and 87 to provide rotational coupling therebetween and to define a viewing segment exposed beneath cylindrical lens array 92.

Ratchet 70 is rotatably supported by a shaft 71 and defines a plurality of inclined ratchet teeth 72 which interact with and engage tooth 42 of tyne 41 solely in response to motion of tyne 41 forwardly in the direction indicated by arrow 64. In the opposite direction, the inclined facets of teeth 72 do not engage tooth 42 of tyne 41. As is described above, ratchet 70 is rotationally coupled to gear 85 of roller 86 by the gear coupling provided by gears 75, 76 and 77. Correspondingly, roller 87 and belt 90 are rotationally coupled to roller 86.

In operation, in the absence of a downward keystroke force upon keyboard unit 15 by the child user, the spring force of spring 51 draws slider 40 to the rearward position shown in solid line representation and maintains slider 40 against limit stop 50. Correspondingly, the spring force applied to slider 40 is communicated to keyboard unit 15 by the contact between edge 28 of finger 26 and front surface 48 of slider 40. As a result, keyboard unit 15 is pivoted upwardly to the general position shown in solid line representation. The upward travel of keyboard unit 15 is further limited by the extension of flange 27 beyond the edge of aperture 16 in housing 11. In this position, the angular orientation of spring 41 urges slider 40 against limit stop 50 such that the rotational force is imparted to slider 40 tending to pivot slider 40 about limit stop 50 in the direction indicated by arrow 66. Correspondingly, this pivotal force raises tyne 41 upwardly to engage tooth 42 against teeth 72 of ratchet 70. This defines the normal or rest position of the operative mechanism within toy computer 10.

An operative cycle is initiated by the child user placing a simulated keystroke upon keyboard unit 15 pivoting keyboard unit 15 downwardly about pivot pin 25 to the dashed line position shown in FIG. 2. The downward force upon keyboard unit 15 overcomes the spring force of spring 51 and causes finger 26 to impart a forward direction force against front surface 48 of slider 40. In response, slider 40 moves forwardly in the direction indicated by arrow 64. As the pivotal motion of keyboard unit 15 and finger 26 continues, the engagement of tooth 42 with ratchet 70 produces a corresponding rotational motion of ratchet 70. As described above, this rotational motion is correspondingly imparted to endless belt 90 by rollers 86 and 87 together with gears 75, 76, 77 and 85. Thus the image elements upon endless belt 90 undergo a corresponding motion beneath cylindrical lens array 92. Concurrently, as keyboard unit 15 continues downwardly, finger 26 pivots against front surface 48 of slider 40 and contacts front surface 48 at a higher point along the front surface producing a force which tends to pivot slider 40 in the direction indicated by arrow 63 upon angled surface 62 which in turn withdraws tooth 42 from teeth 72 of ratchet 70. As a result, tooth 42 begins disengaging ratchet 70 at the completion of the stroke upon keyboard unit 15.

When keyboard unit 15 is released, the spring force provided by spring 51 returns slider 40 to the rearward position against limit stop 50 and pivots keyboard unit 15 upwardly due to the force coupled to finger 26. Concurrently, spring 51 imparts the above-described rotational force to slider 40 in the direction of arrow 66 to once again raise tooth 42 into engagement with ratchet 70. This cycle continues each time the child user presses and releases keyboard unit 15.

Because the rotational motion of ratchet 70 is incremented or limited to a rotational increment for each stroke of keyboard unit 15, the corresponding motion of belt 90 coupled thereto by the above-described gear coupling is correspondingly incremental. The incremental motion applied to ratchet 70 and the stroke of keyboard unit 15 is selected to provide a corresponding incremental motion of belt 90 which corresponds to the distance between each of the magnifying elements 95 and interleaved valleys 96 of cylindrical lens array 92. Correspondingly, the image segments 91 (seen in FIG. 1) on belt 90 are spaced in accordance with this incremental motion. As a result, the detented or incremental motion produced in the viewed image by each keystroke upon keyboard unit 15 produces an image change which is incremental and which appears to the child user to be similar to the type of incremental changes occurring on a typical computer display. Thus the present invention incremental motion mechanism within a toy computer utilizes the cylindrical lens segmented system together with a simple and effective incremental motion system which provides a realistic and amusing computer monitor-like display and closely replicates the operation of a computer to the child user. Because the mechanism works very simply requiring only a single keystroke by the child user, it is suitable for use by extremely young children and provides an important introduction to the basic operational circumstances of a computer.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A toy display system comprising:

a housing defining a viewing aperture and keyboard surface;

a cylindrical lens array covering said viewing aperture defining a lens spacing;

a depressible key supported upon said keyboard surface;

a movable segmented image display having segment spacing corresponding to said lens spacing producing an image viewable through said viewing aperture and said cylindrical lens array; and incremental coupling means coupling said depressible key to said movable image display to incrementally move said image in response each depression of said key through an incremental distance equal to said lens spacing.

2. A toy display system as set forth in claim 1 wherein said incremental coupling means includes:

a ratchet gear;

a movable tyne coupled to said depressible key for engaging said ratchet during each depression of said depressible key; and gear drive means coupling said ratchet to said movable image display.

3. A toy display system as set forth in claim 2 wherein said incremental coupling means includes:

a pivot support for pivotally supporting said depressible key;

a slider supporting said tyne coupled to said depressible key; and spring means urging said slider away from said ratchet.

4. A toy display system as set forth in claim 3 wherein said incremental coupling means includes a limit stop and wherein said spring means urges said slider against said limit stop and urges said slider toward rotation about said limit stop to move said tyne into engagement with said ratchet.

5. A toy display system as set forth in claim 4 wherein said ratchet includes a ratchet gear and wherein said tyne includes an engaging tooth.

6. A toy display system as set forth in claim 5 wherein said slider defines an angled surface and wherein said slider pivots to said angled surface as said key is depressed.

7. A toy display system comprising:

a cylindrical lens array defining a lens spacing;

movable image support beneath said cylindrical lens;

a depressible key;

a segmented image supported upon said image support having image segments spaced in accordance with said lens spacing;

a movable slider coupled to and moved by said key; and a ratchet drive coupled to said slider and said image support, said depressible key moving said slider into engagement with said ratchet drive and imparting an incremental movement thereto which in turn moves said image support incrementally a distance equal to said lens spacing.

8. A toy display as set forth in claim 7, further including spring means urging said slider away from said ratchet drive and urging said depressible key upwardly.

9. A toy display as set forth in claim 8 wherein said ratchet drive includes a ratchet gear having a plurality of angled teeth and wherein said slider includes an extending tyne having a tooth for engaging said angled teeth.

10. A toy display as set forth in claim 9 wherein said toy includes a limit stop and wherein said spring means includes a coil spring coupled to said slider urging said slider against said limit stop and urging said slider toward pivotal motion moving said tooth toward said ratchet gear.

11. For use in a toy resembling a computer in general appearance and having a viewing screen, a toy display comprising:

a depressible key;

a cylindrical lens array defining a lens spacing;

an endless belt supporting a segmented image thereon, said segmented image being formed of image segments spaced in correspondence to said lens spacing;

roller means for supporting said belt and scrolling a portion of said segmented image past said lens array;

incremental motion drive means coupling said key to said roller means such that an incremental movement equal to said lens spacing is imparted to said belt each time said depressible key is depressed; and spring means for raising said depressible key in the absence of a key depressing force.

* * * * *